US005284815A

United States Patent [19]

Uytterhoeven et al.

[11] Patent Number: 5,284,815

[45] Date of Patent: Feb. 8, 1994

[54] THERMAL DYE SUBLIMINATION TRANSFER RECEIVING ELEMENT

[75] Inventors: Herman J. Uytterhoeven, Bonheiden; Emiel A. Verdonck, Berlaar, both of Belgium

[73] Assignee: Agfa-Gevaert, N.V., Mortsel, Belgium

[21] Appl. No.: 867,987

[22] Filed: Apr. 13, 1992

[30] Foreign Application Priority Data

Apr. 15, 1991 [EP] European Pat. Off. ..... 91200874.5

[51] Int. Cl.[5] ..... B41M 5/035; B41M 5/38

[52] U.S. Cl. ..... 503/227; 428/195; 428/423.1; 428/913; 428/914

[58] Field of Search ..... 8/471; 428/195, 423.1, 428/913, 914; 503/227

[56] References Cited

FOREIGN PATENT DOCUMENTS 61-199997 9/1986 Japan ..... 503/227

*Primary Examiner*—B. Hamilton Hess

*Attorney, Agent, or Firm*—Breiner & Breiner

[57] ABSTRACT

Dye-image receiving element for use according to thermal dye sublimation transfer comprising a dye-image receiving layer, said dye-image receiving layer and/or a toplayer provided on top of said dye-image receiving layer (if such toplayer is present) containing a reaction product obtained by crosslinking and curing a non-polymeric compound containing two or more active hydrogen-containing radicals and a compound containing two or more isocyanate groups.

41 Claims, No Drawings

THERMAL DYE SUBLIMINATION TRANSFER RECEIVING ELEMENT

DESCRIPTION

The present invention relates to dye-image receiving elements for use according to thermal dye sublimation transfer.

Thermal dye sublimation transfer also called thermal dye diffusion transfer is a recording method in which a dye-donor element provided with a dye layer containing sublimable dyes having heat transferability is brought into contact with a dye-image receiving element and selectively, in accordance with a pattern information signal, heated with a thermal printing head provided with a plurality of juxtaposed heat-generating resistors, whereby dye from the selectively heated regions of the dye-donor element is transferred to the dye-image receiving element and forms a pattern thereon, the shape and density of which is in accordance with the pattern and intensity of heat applied to the dye-donor element.

A dye-image receiving element for use according to thermal dye sublimation transfer usually comprises a support, e.g. paper or a transparant film, coated with a dye-image receiving layer, into which the dye can diffuse more readily. An adhesive layer may be provided between the support and the receiving layer.

The dye-image receiving layer may comprise as binder, for example, a polycarbonate, a polyurethane, a polyester, a polyamide, a polyvinyl chloride, a polystyrene-co-acrylonitrile, a polycaprolactone or mixtures thereof.

A disadvantage of using such a conventional dye receiving layer is the poor releasability, i.e., when the donor element and the receiving element are peeled apart after the heat transfer has been effected, the donor layer adheres to the receiving layer and thus is peeled to be transferred thereonto, whereby both the sheets will not be fit for use.

In order to improve the releasability it has been proposed to use a cross-linked, cured dye receiving layer. Such receiving layers are described in, for example, EP 394460 and JP 90/95891.

It has also been proposed to use a cross-linked cured layer on top of the receiving layer. Such a cured toplayer is described in EP 349141.

These known cured receiving layer and toplayers are obtained by crosslinking and curing a resin having a cross-linkable reactive group and an additive having a cross-linkable reactive group. The crosslinkable reactive group may be a thermosetting reactive group or an ultraviolet- or electron beam-curing reactive group. In case curing is performed by the action of heat preference is given to resins containing an OH or $NH_2$ radical and an isocyanate additive.

A disadvantage of heat-cured layers obtained by reaction of resins containing a cross-linkable reactive group and an isocyanate compound is the slowness of the curing reaction and the time needed to obtain complete curing of the matrix. The curing reaction is usually carried out by heating at a temperature of about 120° C. to about 160° C. for 10 to 60 minutes. To accelerate the reaction it is customary to add a catalyst to the curable composition.

Furthermore when using a layer obtained by reaction between a resin containing a cross-linkable reactive group and an isocyanate compound curing is effected over the whole thickness of the layer while it is preferred to obtain curing only in the top region of the layer in order to improve releasability.

It is an object of the present invention to provide a cured dye-image receiving element of excellent dyeability and releasability.

It is another object of the present invention to provide a cured dye-image receiving element that is rapidly and easily obtained without the need of using a catalyst.

It is a further object of the present invention to provide a cured dye-image receiving element with preferential curing at the surface of the layer.

Other objects will become apparent from the description hereinafter.

In accordance with the present invention a dye-image receiving element for use according to thermal dye sublimation transfer is provided, said dye-image receiving element comprising a dye-image receiving layer, characterized in that said dye-image receiving layer and/or a toplayer provided on top of said dye-image receiving layer (if such toplayer is present) contains a reaction product obtained by crosslinking and curing a non-polymeric compound containing two or more active hydrogen-containing radicals and a compound containing two or more isocyanate groups.

Such dye image receiving elements are comparable to the known heat-cured dye image receiving elements obtained by crosslinking and curing a resin containing a crosslinkable reactive group and an isocyanate compound regarding dyeability and releasability.

The non-polymeric compounds used according to the present invention are low molecular weight compounds preferably having a molecular weight less than 1500 and most preferably less than 1000. They include oligomers containing not more than four recurring units.

Non-polymeric compounds containing active hydrogen-containing radicals are more reactive than resins containing such radicals. This leads to an acceleration of the curing reaction: the curing takes place within the time needed to dry the layer and it is not necessary to further heat the layer after it is dried as is the case when resins containing such radicals are used.

Further, the non-polymeric compounds containing active hydrogen-containing radicals can be added in excess to the compound containing isocyanate groups and this leads to a more complete curing reaction. The excess of non-polymeric compound can be evaporated afterwards, if it is sufficiently volatile.

A further advantage of using non-polymeric compounds instead of resins is the possibility of selectively curing the surface of the layer.

The non-polymeric compound containing the active hydrogen-containing radicals and the compound containing isocyanate groups can be provided in one single layer and cured. In this case the curing takes place substantially over the whole thickness of the layer.

It is also possible to provide the non-polymeric compound containing active hydrogen-containing radicals in the layer to be cured and the compound containing isocyanate groups in a separate layer on top hereof, or vice versa. During drying of said layers reaction takes place between the non-polymeric compound containing active hydrogen-containing radicals and the compound containing isocyanate groups. In this case curing is effected preferentially on the surface of the layer to be cured.

The polyisocyanate compound used in the present invention is a compound having at least two isocyanate groups. Diisocyanates, triisocyanates or mixtures hereof are preferred. Aliphatic, cycloaliphatic, araliphatic and aromatic polyisocyanates may be used. Mixtures of these polyisocyanates may also be used.

Examples of such polyisocyanate compounds include ethylene diisocyanate; 1,6-hexamethylene diisocyanate; isophorone diisocyanate; cyclohexane-1,4-diisocyanate; 4,4'-dicyclohexylmethane diisocyanate; p-xylylene diisocyanate; 1,4-phenylene diisocyanate; 2,4-toluene diisocyanate; 2,6-toluene diisocyanate; 4,4'-diphenylmethane diisocyanate; 2,4'-diphenylmethane diisocyanate; polymethylene polyphenyl polyisocyanate; 1,5-naphthylene diisocyanate; triphenylmethane triisocyanate and Alpha,Omega-diisocyanate dimethylsiloxane. Of the above compounds 4,4'-diphenylmethane diisocyanate is preferred.

Further polyisocyanates which have been modified by the introduction of urethane, allophanate, urea, biuret, isocyanurate (trimer), carbodiimide, uretonimine, uretdion or oxadiazintrion residues can be used. In this case compounds are formed with various numbers of isocyanate groups such as two, three, four or more isocyanate groups. Examples hereof are the following compounds: Desmodur L, Desmodur HL, Desmodur N, Desmodur IL, Desmodur VL, Desmodur Z-types. Desmodur W. Desmodur 15, Desmodur AP, Desmodur E-types, Desmodur BL 1100 (all supplied by Bayer) and the compounds described in Journal of Coatings Technology, Vol. 59, No. 749 (1987), page 63–72. Of the above compounds Desmodur VL is preferred.

The compounds containing the active hydrogen-containing radicals are compounds containing two or more of the following functional radicals (which may be the same or different): $-NH_2$, $-NH-$, $-NH-NH_2-NH-NH-$, $-NH-OH$, $=N-OH$, $=N-NH_2$, $-NH-CO-NH-$, $-NH-CO-N<$, $-NH-COO-$, $-NH-CO-$, $-NH-SO_2$, $-COOH$, $-OH$ and $-SH$. As compounds containing the same or different active hydrogen-containing functional groups di- tri-, tetra-, penta-, hexa- and possibly higher functional compounds can be used. Mixtures of such compounds can also be used.

As such multifunctional non-polymeric compounds containing said active hydrogen-containing radicals there can be mentioned: amines, alcohols and phenols, carboxylic acids, hydroxy-carboxylic acids, amino-carboxylic acids, hydroxy-amino compounds, etc.

Examples of compounds containing two or more $-NH-$ and/or $-NH_2$ radicals for use according to the present invention include ethylene diamine; diethylene diamine; hexamethylene diamine: p-phenylene diamine; tricyclodecyl diamine; tetramethylene N,N'-bis-(Gamma-amino-propyl)diamine; diethylene triamine; dodecyl diethylene triamine; diethylene N,N''-bis-(1-ethyl-3-methyl-pentyl)triamine; dipropylene triamine; triethylene tetramine; tetraethylene tetramine mono(undecyl)-carbonamide; tetraethylene pentamine; pentaethylene hexamine; di(Epsilon-amino-amyl)amine; di-(Delta-amino-butyl)-amine; Jeffamine; diamino anisole; p,p-diaminodiphenyl sulfon; 1,2,3-triaminobenzene; 1,3-diamino-2-(Beta-aminoethyl)benzene; p,p-diaminodiphenyl methane; 1,1,1-tri-(aminomethyl)-ethane and 4,4'-diamino-dicyclohexyl-methane.

Examples of compounds containing two or more -OH radicals for use according to the present invention include ethylene glycol; diethylene glycol; triethylene glycol; neopentylglycol; 1,2-propanediol; 1,3-propanediol; N,N-di(n-decyl)amino-2,3-propanediol; 1,4-butanediol; 3-hydroxymethyl-2,4-pentanediol; 1,2-hexanediol; 1,6-hexanediol; 1,4-cyclohexanediol; 1,8-octanediol; 1,2-octanediol; 1,9-nonanediol; 1,2-decanediol; 1,10-decanediol; 1,11-undecanediol; 1,12-dodecanediol; 1,2-dodecanediol; 1,13-tridecanediol; 1,14-tetradecanediol; 1,15-pentadecanediol; 1,2-hexadecanediol; 1,16-hexadecanediol; 1,17-heptadecanediol; 1,12-octadecanediol; 1,4-octadecanediol; 1,18-octadecanediol; 1,2-epoxyoctadecanediol; 9-octadecene-1,12-diol; 1,19-nonadecanediol; 1,20-eicosanediol; 1,21-heneicosanediol; 1,22-docosanediol; 1,25-pentacosanediol; 1,2,4-butanetriol; 1,2,6-hexanetriol; 1,2,2-trimethylol-ethane; 1,1,1-trimethylol-ethane; 2,2'-bis(4-hydroxy-cyclohexyl)propane; 1,1,1-tri(hydroxymethyl)propane; trimethylolpropane; 1,4-dihydroxy-2-(hydroxymethylene)pentane; 1,2,5-trihydroxypentane; pentahydroxypentane; 4,4-bis(4-hydroxyphenyl)-l-n-dodecane; 2,2,5,5-tetramethylol-cyclopentanol; 2,2,6,6-tetramethylol-cyclohexanol; 1,4-cyclohexane dimethanol; tri-isopropanolamine, triethanolamine; diethanolamino methylol; diethanolamino 2-propanol; methylamine monoethanol mono(2,3-dihydroxypropyl); xylitol; Bisphenol A; glycerine; glycerine mono stearate; glycerine mono oleate; glycerine mono ricinoleate; glycerine mono laurate; glycerine mono caprylate; pentaerytritol; dipentaerytritol; pentaerytritol distearate; meso-erytritol; N,N-di(-hydroxyethyl)stearic amide; tetraethylene pentamine heptaethanol; tetraethylene pentamine hepta(N,N-diethanol)amine 2-hydroxypropylene; ethylenediamine tetra(2,3-dihydroxypropane); ethylenediamine tetra(2-hydroxypropyl); 1,3-propylenediamine tetra(2-hydroxypropyl); ethylenediamine tetra(Beta-hydroxyethane); ethylenediamine monohydroxyethyl tri(2-hydroxypropyl); 1,3,5-trihydroxy benzene; 1,2,3-trihydroxy benzene; 1,2,4-trihydroxy benzene; 1,2,3-trihydroxy-6-t-butyl benzene; 2,4,6-trihydroxy toluene; hydroquinone; 2,3-di(hydroxymethyl)-5-octadecyl hydroquinone; 2,5-di(hydroxymethyl) hydroquinone; catechol; 4,6-di-t-butyl-catechol; 4,4'-(2,3-dimethyl-tetramethylene) dipyrocatechol; resorcin; 2-nitro-resorcinol; 4-n-dodecyl-resorcinol; 2,4-dihydroxy acetophenone; 3,4-dihydroxy benzaldehyde; heptadecyl-2,4-dihydroxyphenyl-ketone; cardol; dimer fatty alcohols; sorbitan fatty acid esters (e.g., sorbitan stearate, sorbitan oleate and sorbitan palmitate); carbohydrates such as glucose, galactose, saccharose, mannose, xylose, arabinose, maltose, lactose monohydrate, ribose, fructose, sorbitol, hematoxyline, mannite, ascorbic acid, dehydro-ascorbic acid; arboroles as described in Journal of the American Chemical Society (1990), Vol. 112, pages 8458 to 8465 such as compounds ARB1 and ARB2 as shown below.

$$((HOCH_2-)_3C-NH-CO)_2-CH-CH_2-CH-(-CO-NH-C(-CH_2OH)_3)_2 \quad \text{ARB1}$$

$$((HOCH_2-)_3C-NH-CO)_2-CH-(CH_2)_{10}-CH-(CO-NH-C(-CH_2OH)_3)_2 \quad \text{ARB2}$$

Examples of compounds containing two or more $-COOH$ radicals for use according to the present invention include glutaric acid; itaconic acid; maleic acid; adipic acid; sebacic acid; azelaic acid; 1,4-cyclohexane dicarboxylic acid; decane dicarboxylic acid; undecane dicarboxylic acid; dodecane dicarboxylic acid; tridecane dicarboxylic acid: tetradecane dicarboxylic acid;

heptadecane dicarboxylic acid; octadecane dicarboxylic acid; nonadecane dicarboxylic acid; eicosane dicarboxylic acid; docosane dicarboxylic acid; malonic acid; tetradecylmalonic acid; hexadecylmalonic acid; octadecylmalonic acid; diheptylmalonic acid; succinic acid; octylsuccinic acid; decylsuccinic acid; dodecylsuccinic acid; tetradecylsuccinic acid; hexadecylsuccinic acid; octadecylsuccinic acid; octenylsuccinic acid; iso-octenylsuccinic acid; decenylsuccinic acid; dodecenylsuccinic acid; tetradecenylsuccinic acid; hexadecenylsuccinic acid; octadecenylsuccinic acid; docosylsuccinic acid; docosenylsuccinic acid; tetrapropenylsuccinic acid; triacontenylsuccinic acid; polyisobutenylsuccinic acid; nonadecane-1,2,3-tricarboxylic acid; nonadecane-1,3,3-tricarboxylic acid; octadecane-1,1,2-tricarboxylic acid; octadecane-1,2,2-tricarboxylic acid; heptadecane-1,2,3-tricarboxylic acid; heptadecane-1,3,3-tricarboxylic acid; hexadecane-1,1,2-tricarboxylic acid; heptane-1,2,3-tricarboxylic acid; propane-1,2,3-tricarboxylic acid; butane-1,2,4-tricarboxylic acid; nonadecane-1,2,3,3-tetracarboxylic acid; 1,2,3,4-tetracarboxybutane; 1,1,12,12-tetracarboxydodecane; 1,2,3,4,5,5-hexa-(Beta-carboxyethyl) cyclopentadiene; benzene 1,3,5-tricarboxylic acid; benzene 1,2,3-tricarboxylic acid; benzene 1,2,4-tricarboxylic acid; benzene 1,2,4,5-tetracarboxylic acid; benzene hexacarboxylic acid; nitrilo-triacetic acid; ethylene diamine triacetic acid mono(l-octadecanoic acid); N,N'-p-phenylene diamine tetracetic acid; 1,2-diamino cyclohexane tetracetic acid; ethyleneglycol bis(2-aminoethyl) tetracetic acid; ethylene diamine tetracetic acid; hexamethylene diamine tetracetic acid; 1,2-propylene diamine tetracetic acid; 1,3-propylene diamine tetracetic acid; diethylene triamine pentacetic acid; triethylene tetraamine hexacetic acid; tetraethylene pentaamine heptacetic acid; nitrilo tripropionic acid; dimer fatty acids and derivatives such as PRIPOL 1008/1009 (CAS registry no. 68783-41-5) which is a mixture of aromatic, cycloaliphatic and aliphatic $C_{36}$ dimer fatty acid isomers and PRIPLAST 3008 (CAS registry no. 68956-10-5) which is the dimethyl ester of said dimer acid, PRIPOL 1004 which is a $C_{44}$ dimer fatty acid (all supplied by Unichema), EMPOL supplied by Quantum Chemicals which is a $C_{36}$ aliphatic dimer acid and UNIDYME 14 and UNIDYME 60 supplied by Union Camp.

Examples of compounds containing two or more different active hydrogen-containing radicals for use according to the present invention include N-hydroxyethylethylene diamine; ethylene diamine N,N'-di(2-hydroxy-3-diethanolamine-propylene); ethylene diamine monoethanol; 1,3-propylene diamine monoethanol; ethylene diamine N,N'-diethanol; p-phenylene diamine N,N-diethanol; ethylene diamine monopropanol; ethylene diamine N,N'-di-isopropanol; 1,3-diamino 2-propanol; 1,2-diamino 3-propanol; 3-amino-2',4'-dihydroxy-benzophenone; salicylic acid; acetylsalicylic acid; diethanol mono(acetic acid)amine; resorcine-2,4-dicarboxylic acid; 2,5-di-hydroxy-terephthalic acid; 3-(3,4-dihydroxyphenyl)-propionic acid; hydroxybenzoic acid; 3,5-dihydroxybenzoic acid; 2.5-dihydroxybenzoic acid; 2,6-dihydroxybenzoic acid; 2,4-dihydroxybenzoic acid; 2,3-dihydroxybenzoic acid; 3,4-dihydroxybenzoic acid; 2,3-dihydroxy-4-(Beta-hydroxyethoxy) benzoic acid; 2,4,6-trihydroxy-benzoic acid; 3,4,5-trihydroxy-benzoic acid; 2,4,5-trihydroxy-benzoic acid; 2,3,4-trihydroxy-benzoic acid; 2,5-di-propionic acid hydroquinone; 2-(Gamma-carboxy-propyl)-hydroquinone; 2-carboxy-5-methyl-hydroquinone; diethylene-triamine-monoacetic acid-monododecyl; ethylene-diamine-N,N'-diacetic acid; ethylene-diamine-N,N-diacetic acid; tetraethylene-pentaamine-diacetic acid; 1,3-propylene-diamine-N,N'-dipropionic acid; dipropylene-triamine-N,N'-dipropionic acid; 4,6-diamino-iso-phthalic acid; 1,3-propylene-diamine-N-(2-methylbutanoic acid)-N'-dodecyl; ethylenediamine-mono(l-octadecanoic acid); 11-amino-undecanoic acid;. 12-amino-dodecanoic acid; 1-glutaminic acid; Alpha-amino-pelargonic acid; Alpha-amino-pentane carboxylic acid; Omega-amino-capronic acid; amino-succinic acid; 4-amino-butyric acid; 4-amino-cyclohexane carboxylic acid; aminoacids such as glycine, alanine, valine, leucine, isoleucine, phenylalanine, proline, methionine, serine, threonine, tyrosine, lysine, hydroxylysine, arginine, histidine, asparaginic acid, glutaminic acid, N-methyl-D-glucosamine; diacetic acid-monoethanolamine; ethylene-diamine-N,N'-diethanol-N,N'-diacetic acid; (trimethanol)methylene-amine-diacetic acid; ethylene-diamine-triacetic acid-monoethanol; 1,3-diamino-2-propanol-tetraacetic acid; 2,5-di(2-hydroxyethylamino)-terephthalic acid.

The non-polymeric compound containing the active hydrogen-containing radicals used according to the present invention can further contain other non-reactive groups such as nitro, halogen, ketone, aldehyde, sulfonate, sulfone, phosphate, ester or ether groups.

The non-polymeric compound containing the active hydrogen-containing radicals can further contain a functional group that imparts to the receiving element, for example, a stabilizing, plasticizing, releasing, glossy or mat effect.

Examples of such compounds that incorporate besides the active hydrogen-containing radicals also an antioxidising group are listed below.

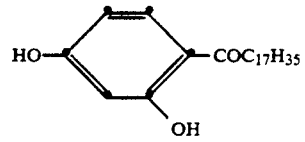

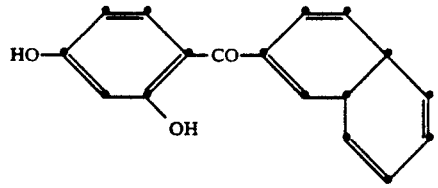

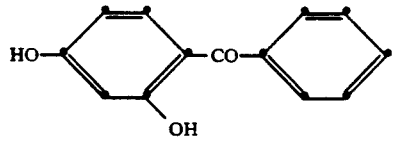

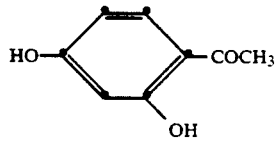

-continued

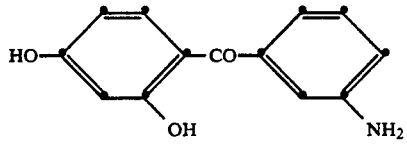

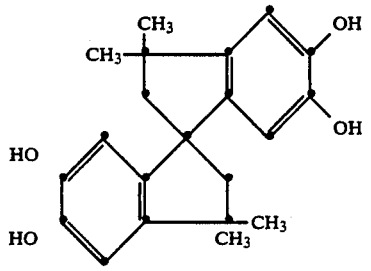

(001)

The amount of non-polymeric compound containing active hydrogen-containing radicals and the amount of compound containing isocyanate groups is preferably such that the mole ratio of NCO/active hydrogen-containing radical is between 2/1 and 1/10 and preferably between 1/1 and 1/5.

The cured layer according to the present invention may be formed by providing a composition for forming the layer by dissolving or dispersing the non-polymeric compound and the polyisocyanate compound (and optionally other additives) in a solvent and coating that composition on a support by suitable means followed by drying. During the drying step (1 to 2 minutes at 1200° C.) crosslinking and curing takes place. After drying a post heating step (1 to 5 minutes at 120° C.) may be carried out so as to obtain a still higher degree of crosslinking. Due to the high mobility of the non-polymeric compound in the dried layer the curing reaction can further continue at room temperature, thereby avoiding the need for a post heating step.

One of the reaction partners can initially be present in another layer. For example the cured layer is formed by coating a composition containing the non-polymeric compound (and optionally other additives) on the support followed by drying. Subsequently a composition containing the isocyanate compound (and optionally other additives) is coated on top of this layer and dried. A post heating step (1 to 5 minutes at 120° C.) may be carried out. This can also be carried out vice versa, namely with the isocyanate compound in the receiving layer and the non-polymeric compound in the toplayer.

In order to further accelerate the curing reaction between the non-polymeric compound and the polyisocyanate compound in accordance with the present invention a catalyst may be added. Catalysts used to this end include tertiary amines (e.g. triethylamine) and organic metallic compounds.

Especially organometallic compounds based on dibutyltin or dioctyltin are generally used. Examples of catalysts based on dibutyltin include dibutyltin dilaurate, dibutyltin oxide, dibutyltin dichloride, dibutyltin di-2-ethylhexyl thioglycolate, dibutyltin di(monobutyl) maleate, dibutyltin di(monononyl) maleate, dibutyltin diacetate, dibutyltin mercaptide, dibutyltin Beta-mercaptopropionate, dibutyltin thiocarboxylate and dibutyltin di-2-ethylhexoate. Examples of catalysts based on dioctyltin include dioctyltin dilaurate, dioctyltin thioglycolate, dioctyltin Beta-mercaptopropionate, dioctyltin-1,4-butanediol-bis(mercaptoacetate), dioctyltin ethylene glycol thioglycolate, dioctyltin thiocarboxylate, dioctyltin maleate, dioctyltin maleate polymer, dioctyltin-(1,2-propylene glycol maleate), dioctyltin-di-(monobutyl) maleate, dioctyltin-bis-(2-ethylhexyl maleate), dioctyltin-bis-(lauryl thioglycolate), dioctyltin oxide, dioctyltin dichloride, mono-octyltin dichloride and trioctyltin dichloride.

Other organometallic compounds, which may be used as catalysts in accordance with the present invention include stannous octoate, lead octoate, cobalt naphthenate, stannous chloride, stannic chloride, tetra-n-butyltin, tetraphenyltin, trimethyltin hydroxide and dimethyl-2-tin chloride.

Particular preference is given to dibutyltin dilaurate.

In the case of a cured toplayer according to the present invention a binder is not necessary but may be used. Examples of binders that may be used in such a toplayer are nitrocellulose, styrene copolymers, polyesters, polycarbonates and co-vinylchloride-vinylacetates.

In the case of a cured dye receiving layer according to the present invention it is necessary to include a binder in said layer.

As binder there can be used any binder known in dye receiving layers of thermal transfer materials, for example, polyesters such as described in European patent applications nos 90202759 and 90202760, solvent soluble polyesters such as VYLON supplied by Toyobo, DYNAPOL supplied by Huls Chemie and VITEL supplied by Goodyear, co-vinylchloride-vinylacetates such as VINYLITE and UCAR types VYNS-3, VYHH, VYHD and VYLF supplied by Union Carbide, polycarbonates, polyurethanes, styrene copolymers (e.g. co-styrene-acrylonitrile), polyamides. etc. Examples of such resins are described in, e.g., EP 133011, EP 133012, EP 144247, EP 227094 and EP 22806 6. Mixtures of these resins can also be used.

The amount of binder used in the dye receiving layer of the present invention is from 50 to 95% by weight, preferably about 80% by weight.

The dye receiving layer of the present invention can contain as binder a resin containing active hydrogen-containing radicals that is then cured together with the non-polymeric compound and the polyisocyanate compound used in accordance with the present invention. These resins may include polyester resins, acrylic resins, vinyl resins, polyurethane resins, cellulosic resins. polysaccharides, which are modified by introducing into their molecular chains one or more active hydrogen radicals. These resins may be used alone or in a combination of two or more of such resins or they can be used in combination with a conventional binder for a receiving layer as listed above.

Examples of such isocyanate curable resins are: vinyl chloride/vinyl acetate copolymers modified with vinyl alcohol or hydroxyalkylacrylate or maleic acid or epoxy (e.g. the UCAR type resins VMCH, VMCC, VMCA, VAGH, VAGD, VAGF, VAGC, VYNC, VROH, VYES, VYES-4, VP-200 and VERR-40 supplied by Union Carbide); linear or branched polyesters or polyethers or polyacrylates containing an OH radical such as the Desmophen types 550 U. 651, 670, 690, 800, 1200, 1700, 1800, RD 181 supplied by Bayer; cellulose derivatives and gelatine.

These isocyanate curable resins are also suitable for forming on themselves together with a polyisocyanate compound a cured dye-receiving layer (i.e. without a non-polymeric compound containing active hydrogen-containing radicals). The ratio equivalent NCO/ active hydrogen is for these systems preferably between 0.1 and 2 and the weight percentage of active hydrogen in the resin (or resin mixture) is between 0.05 and 1 wt % (e.g. for OH radical between 0.85 and 17 wt %). The composition of such dye receiving element regarding optional additives, intermediate layers, support material, etc. can be as is set forth hereinafter for the curable dye receiving element of the present invention.

The heat-curable system of the present invention based on isocyanate and non-polymeric compounds containing active hydrogen-containing radicals can also be used in combination with a heat-curable system based on isocyanate and particles containing active hydrogen-containing radicals, preferably at the surface of said particles, e.g. the silica organosols marketed under the tradename HIGHLINK OG by Hoechst which are non-agglomerated colloidal silica particles modified by functional organic molecules.

These isocyanate curable particles are also suitable for forming on themselves together with a polyisocyanate compound a cured dye-receiving layer (i.e. without a non-polymeric compound containing active hydrogen-containing radicals). The composition of such dye receiving element regarding optional additives, intermediate layers, support material, etc. can be as is set forth hereinafter for the curable dye receiving element of the present invention.

The heat-curable system of the present invention based on isocyanate and non-polymeric compound containing active hydrogen-containing radicals can also be used in combination with another heat-curable system.

Examples of such other heat-curable systems that can be used in such combination are: heat-curable systems based on carbamoylpyridinium salts (and derivatives thereof of the type described in U.S. Pat. No. 3880665 and U.S. Pat. No. 4063952 ) and compounds containing carboxyl and amino radicals (non-polymeric compounds and/or resins e.g. gelatine); heat-curable systems based on the reaction between amino. carboxyl, aldehyde (or ketone) and isonitrite compounds i.e. the reaction known as the 4 Compound Condensation (4CC) reaction as described by Ugi in Intrascience Chemistry Reports (1971). Vol. 3, page 229, in Angew. Chem. (1962), Vol. 74, page 9, and in Neuere Methoden der prgparativen Org. Chemie, Foerst Verlag Chemie, Vol. 4, page 1; heat-curable systems based on the reaction between vinylsulfones and compounds containing amino radicals (non-polymeric compounds or resins).

These heat-curable systems are also suitable for forming a cured dye-receiving layer or toplayer on themselves (i.e. not in combination with the heat-curable system of the present invention based on isocyanate and non-polymeric compound containing active hydrogen-containing radicals). The composition of such dye receiving element regarding optional additives, intermediate layers, support material, etc. can be as is set forth hereinafter for the curable dye receiving element of the present invention.

A release agent containing a crosslinkable reactive group may also be incorporated as a part of the material forming the cured layer. These release agents may include silicone, fluorine, long-chain aliphatic hydrocarbon compounds, waxes and other like substances , which are modified by introducing into their molecular chains one or more active hydrogen-containing radicals. In this case the release agent, the non-polymeric compound and the polyisocyanate compound are cross-linked and cured in combination. Examples of such release agents are amino modified silicone oil and epoxy modified silicone oil.

High boiling organic solvents or thermal solvents or plasticizers can be included in the image-receiving layer, as substances which can accept or dissolve the dyes or as diffusion promotors for the dyes. Useful examples of such high boiling organic solvents and thermal solvents include the compounds disclosed in, for example, JP 62/174754, JP 62/245253, JP 61/209444, JP 61/200538, JP 62/8145, JP 62/9348, JP 62/302 47, JP 62/136646.

For the purpose of improving the whiteness of the receiving layer to enhance sharpness of the transferred image and also imparting writability to the receiving surface as well as preventing retransfer of the transferred image, a white pigment can be added to the receiving layer. As white pigment, titanium oxide, zinc oxide, kaolin, clay, calcium carbonate, fine powdery silica, etc. can be employed, and these can be used as a mixture of two or more kinds as described above.

Also, for further enhancing the light resistance of the transferred image, one or two or more kinds of additives such as UV-ray absorbers, light stabilizers and antioxidants, can be added, if necessary. The amounts of these UV-ray absorbers and light stabilizers is preferably 0.05 to 10 parts by weight and 0.5 to 3 parts by weight, respectively, per 100 parts of the resin constituting the receiving layer.

The dye receiving element of the present invention can contain a release agent (in the receiving layer or the toplayer) for improvement of the release property with respect to the donor element. As the release agent, solid waxes such as polyethylene wax, amide wax, and Teflon powder; fluorine based and phosphate ester based surfactants; and paraffin based, silicone based and fluorine based oils. Silicone oils, preferably reactive silicone oils and silicone containing copolymers such as a polysiloxane-polyether copolymer and blockcopolymers, are preferred (e.g. TEGOGLIDE supplied by Goldschmidt and SILWET supplied by Union Carbide.

As the support for the receiver sheet it is possible to use a transparant film or sheet of various plastics such as polyethylene terephthalate, polyolefin, polyvinyl chloride, polystyrene, polycarbonate, polyether sulfone, polyamide, cellulose ester or polyvinyl alcohol-co-acetal. Blue-colored polyethylene terephthalate film can also be used. The support may also be a reflective support such as paper e.g. top quality paper, art paper, cellulose fiber paper; baryta-coated paper; polyolefin-coated paper e.g. dual polyethylene-coated paper; synthetic paper e.g. polyolefin type, polystyrene type or white polyester type i.e. white-pigmented polyester.

Also, a laminated product by any desired combination of the above can be used. Typical examples of the laminates include a laminate of cellulose fiber paper and synthetic paper and a laminate of cellulose fiber paper and a plastic film or sheet. As further examples of the laminates, a plastic film can be used with synthetic paper instead of cellulose fiber paper. Further, a laminate of cellulose fiber paper, plastic film and synthetic paper can also be used.

The support sheet serves to support the dye receiving layer, and it is desirable that the support sheet has mechanical strength sufficient enough to handle the dye receiving sheet which is heated at the time of heat transfer recording. If the dye-receiving layer alone has the necessary mechanical strength, the support sheet may be omitted.

The dye-receiving layer of the present invention preferably has an overall thickness of from 0.5 to 50 um, more preferably from 2.5 to 10 um, when the dye-receiving layer is provided on a support sheet, or preferably from 3 to 120 um when it is self-supporting i.e. a support sheet is omitted.

The image receiving layer may be a single layer, or two or more such layers may be provided on the support.

Also receiving layers may be formed on both surfaces of the support. In the case of a transparant support recto-verso printing on both receiving layers as described in European Patent Application No. 90200930.7 then leads to an increase in density of the transferred image.

In case a toplayer is provided the thickness of such a toplayer is preferably 0.01 to 5 um, particularly 0.05 to 2 um.

The image receiving element of the present invention may also have one or more intermediate layers between the support and the image receiving layer. Depending on the material from which they are formed, the intermediate layers may function as cushioning layers, porous layers or dye diffusion preventing layers, or may fulfill two or more of these functions, and they may also serve the purpose of an adhesive, depending on the particular application.

The material constituting the intermediate layer may include, for example, an urethane resin, an acrylic resin, an ethylenic resin, a butadiene rubber, or an epoxy resin. The thickness of the intermediate layer is preferably from 2 to 20 um.

Dye diffusion preventing layers are layers which prevent the dye from diffusing into the support. The binders used to form these layers may be water soluble or organic solvent soluble, but the use of water soluble binders is preferred, and especially gelatin is most desirable.

Porous layers are layers which prevent the heat which is applied at the time of thermal transfer from diffusing from the image receiving layer to the support to ensure that the heat which has been applied is used efficiently.

Fine powders consisting of silica, clay, talc, diatomaceous earth, calcium carbonate, calcium sulfate, barium sulfate, aluminum silicate, synthetic zeolites, zinc oxide, lithophone, titanium oxide or alumina for example, can be included in the image receiving layers, cushioning layers, porous layers, diffusion preventing layers and adhesive layers, etc. constituting the thermal transfer image receiving element of the present invention.

Also, the image receiving element of the present invention can have antistatic treatment applied to the front or back surface thereof. Such antistatic treatment may be carried out by incorporating an antistatic agent in, for example, the image receiving layer which becomes the front surface or in an antistatic preventive layer applied to the image receiving surface. A similar treatment can also be effected to the back surface. By such treatment, mutual sliding between the image receiving sheets can be smoothly performed, and there is also the effect of preventing the attachment of dust on the image receiving sheet.

Furthermore, the image receiving sheet can have a lubricating layer provided on the back surface of the sheet support. The material for the lubricating layer may include methacrylate resins such as methyl methacrylate, etc. or corresponding acrylate resins, vinyl resins such as vinyl chloride-vinyl acetate copolymer.

The receiving element can have detection marks provided on one surface, preferably the back surface so that the receiving element can be accurately set at a desired position during transfer, whereby the image can be formed always at a correct desired position.

For the formation of black thermal dye sublimation transfer images representing radiographic diagnostic information as described e.g. in European Patent Application no. 91200791.1 filed Apr. 5,1991, on transparant or blue-colored film support, said support may be provided before or during or after the sublimation transfer cycle with black margins or colored margins having a high density of at least two, surrounding the image area of only one image if only one image is reproduced or all of the image areas if a number of images is reproduced, in order to avoid glare at the edges impairing interpretation by the radiologist on the viewing illuminator.

These black or colored margins can be provided in a number of ways.

For example, during manufacturing of the support for the image receiving material the margins can be realised by printing either on the backside or receptor side of the support (offset, gravure, screen, flexo, electrophotographic or ionographic printing). The margins can be provided before or after cutting the support material into sheets.

A special dye donor element comprising a separate area containing black or colored material can be used to provide said margins on the receptor element by heat, light and/or pressure during the sublimation transfer cycle.

After sublimation transfer the margins can be provided sheet by sheet on the image receiving element by any of the printing processes referred to above.

The margins when provided before sublimation transfer can be used not only to avoid undesirable glare but also to accurately set the image receiving element at a desired position during transfer printing. They can contain detection marks for this purpose.

A dye-donor element for use according to thermal dye sublimation transfer in combination with the present receiving element usually comprises a very thin support e.g. a polyester support, one side of which is covered with a dye layer, which contains the printing dyes. Usually an adhesive or subbing layer is provided between the support and the dye layer. Normally the opposite side is covered with a slipping layer that provides a lubricated surface against which the thermal printing head can pass without suffering abrasion. An adhesive layer may be provided between the support and the slipping layer.

The dye layer can be a monochrome dye layer or it may comprise sequential repeating areas of different colored dyes like e.g. of cyan, magenta, yellow and optionally black hue. When a dye-donor element containing three or more primary color dyes is used, a multicolor image can be obtained by sequentially performing the dye transfer process steps for each color.

The dye layer of such a thermal dye sublimation transfer donor element is formed preferably by adding the dyes, the polymeric binder medium, and other optional components to a suitable solvent or solvent mixture, dissolving or dispersing the ingredients to form a coating composition that is applied to a support, which may have been provided first with an adhesive or subbing layer, and dried.

The dye layer thus formed has a thickness of about 0.2 to 5.0 um, preferably 0.4 to 2.0 um, and the ratio of dye to binder is between 9:1 and 1:3 by weight, preferably between 2:1 and 1:2 by weight.

As polymeric binder the following can be used: cellulose derivatives, such as ethyl cellulose, hydroxyethyl cellulose, ethylhydroxy cellulose, ethylhydroxyethyl cellulose, hydroxypropyl cellulose, methyl cellulose, nitrocellulose, cellulose acetate formate, cellulose acetate hydrogen phthalate, cellulose acetate, cellulose acetate propionate, cellulose acetate butyrate, cellulose acetate pentanoate, cellulose acetate benzoate, cellulose triacetate; vinyl-type resins and derivatives, such as polyvinyl alcohol, polyvinyl acetate, polyvinyl butyral, copolyvinyl butyral-vinyl acetal-vinyl alcohol, polyvinyl pyrrolidone, polyvinyl acetoacetal, polyacrylamide; polymers and copolymers derived from acrylates and acrylate derivatives, such as polyacrylic acid, polymethyl methacrylate and styrene-acrylate copolymers; polyester resins; polycarbonates; copolystyrene-acrylonitrile; polysulfones; polyphenylene oxide; organosilicones, such as polysiloxanes; epoxy resins and natural resins, such as gum arabic. Preferably cellulose acetate butyrate or copolystyrene-acrylonitrile(-butadieen) is used as binder for the dye layer.

Any dye can be used in such a dye layer provided it is easily transferable to the dye-image-receiving layer of the receiver sheet by the action of heat.

Typical and specific examples of dyes for use in thermal dye sublimation transfer have been described in, e.g.. EP 453020, EP 209990, EP 209991, EP 216483, EP 218397, EP 227095, EP 227096, EP 229374, EP 235939, EP 247737, EP 257577, EP 257580. EP 258856, EP 279330, EP 279467, EP 285665, EP 400706, U.S. Pat. No. 4743582, U.S. Pat. No. 4753922, U.S. Pat. No. 4753923, U.S. Pat. No. 4757046, U.S. Pat. No. 4769360, U.S. Pat. No. 4771035, JP 84/78894, JP 84/78895, JP 84/78896, JP 84/227490, JP 84/227948, JP 85/27594, JP 85/30391 . JP 85/229787, JP 85/229789, JP 85/229790, JP 85/229791, JP 85/229792, JP 85/229793. JP 85/229795, JP 86/41596, JP 86/268493, JP 86/268494, JP 86/268495 and JP 86/284489.

The coating layer may also contain other additives, such as curing agents, preservatives, organic or inorganic fine particles, dispersing agents, antistatic agents, defoaming agents, viscosity controlling agents, etc., these and other ingredients being described more fully in EP 133011, EP 133012, EP 111004 and EP 279467.

Any material can be used as the support for the dye-donor element provided it is dimensionally stable and capable of withstanding the temperatures involved, up to 4000° C. over a period of up to 20 msec, and is yet thin enough to transmit heat applied on one side through to the dye on the other side to effect transfer to the receiver sheet within such short periods, typically from 1 to 10 msec. Such materials include polyesters such as polyethylene terephthalate, polyamides, polyacrylates, polycarbonates, cellulose esters, fluorinated polymers, polyethers, polyacetals, polyolefins, polyamides, glassine paper and condenser paper. Preference is given to a polyethylene terephthalate support. In general, the support has a thickness of 2 to 30 um. The support may also be coated with an adhesive or subbing layer, if desired.

The dye layer of the dye-donor element may be coated on the support or printed thereon by a printing technique such as a gravure process.

In order to obtain transferred images of high density, for example for obtaining a hard copy of a medical diagnostic image, a double-layered structure can be used for the dye layer, i.e. two dye layers containing dye(s) and binder(s) with the same or different dye/-binder ratios and/or the same or different dyes and/or the same or different binders.

A dye-barrier layer comprising a hydrophilic polymer may also be employed in the dye-donor element between its support and the dye layer to improve the dye transfer densities by preventing wrong-way transfer of dye towards the support. The dye barrier layer may contain any hydrophilic material which is useful for the intended purpose. In general, good results have been obtained with gelatin, polyacryl amide, polyisopropyl acrylamide, butyl methacrylate grafted gelatin, ethyl methacrylate grafted gelatin, ethyl acrylate grafted gelatin, cellulose monoacetate, methyl cellulose, polyvinyl alcohol, polyethylene imine, polyacrylic acid, a mixture of polyvinyl alcohol and polyvinyl acetate, a mixture of polyvinyl alcohol and polyacrylic acid or a mixture of cellulose monoacetate and polyacrylic acid. Suitable dye barrier layers have been described in e.g. EP 227091 and EP 228065. Certain hydrophilic polymers, for example those described in EP 227091, also have an adequate adhesion to the support and the dye layer, thus eliminating the need for a separate adhesive or subbing layer. These particular hydrophilic polymers used in a single layer in the donor element thus perform a dual function, hence are referred to as dye-barrier/-subbing layers.

Preferably the reverse side of the dye-donor element can be coated with a slipping layer to prevent the printing head from sticking to the dye-donor element. Such a slipping layer would comprise a lubricating material such as a surface active agent, a liquid lubricant, a solid lubricant or mixtures thereof, with or without a polymeric binder. The surface active agents may be any agents known in the art such as carboxylates, sulfonates, phosphates, aliphatic amine salts, aliphatic quaternary ammonium salts, polyoxyethylene alkyl ethers, polyethylene glycol fatty acid esters, fluoroalkyl $C_2$–$C_{20}$ aliphatic acids. Examples of liquid lubricants include silicone oils, synthetic oils, saturated hydrocarbons and glycols. Examples of solid lubricants include various higher alcohols such as stearyl alcohol, fatty acids and fatty acid esters. Suitable slipping layers are described in e.g. EP 138483, EP 227090, U.S. Pat. No. 4567113, US 4572860, U.S. Pat. No. 4717711. Preferably the slipping layer comprises as binder a styrene-acrylonitrile copolymer or a styrene-acrylonitrile-butadiene copolymer or a mixture thereof and as lubricant in an amount of 0.1 to 10% by weight of the binder (mixture) a polysiloxane-polyether copolymer or polytetrafluoroethylene or a mixture thereof.

The dye layer of the dye-donor element may also contain a releasing agent that aids in separating the dye-donor element from the dye-receiving element after transfer. The releasing agents can also be applied in a separate layer on at least part of the dye layer. For the releasing agent solid waxes, fluorine- or phosphate-containing surfactants and silicone oils are used. Suitable releasing agents are described in e.g. EP 133012, JP 85/19138, EP 227092.

The dye-receiving elements according to the invention are used to form a dye transfer image. Such a process comprises placing the dye layer of the donor element in face-to-face relation with the dye-receiving layer of the receiver sheet and imagewise heating from the back of the donor element. The transfer of the dye is accomplished by heating for about several milliseconds at a temperature of 4000° C.

When the process is performed for but one single color, a monochrome dye transfer image is obtained. A multicolor image can be obtained by using a donor element containing three or more primary color dyes and sequentially performing the process steps described above for each color. The above sandwich of donor element and receiver sheet is formed on three occasions during the time when heat is applied by the thermal printing head. After the first dye has been transferred, the elements are peeled apart. A second dye-donor element (or another area of the donor element with a different dye area) is then brought in register with the dye-receiving element and the process repeated. The third color and optionally further colors are obtained in the same manner.

In order to accomplish a perfect register when the process is performed for more than one color and in order to detect what color is existing at the printing portion of the donor element, detection marks are commonly provided on one surface of the donor element. Generally optically detectable marks are used that can be detected by a light source and a photo sensor; detection can be done by measuring the light transmitted through the detection mark or reflected from said mark. The marks being in the form of a light-absorbing or light-reflecting coating are formed in a preassigned position on the donor element by e.g. gravure printing. The detection marks can comprise an infrared absorbing compound such as carbon black. The detection mark can also comprise one of the image dyes that are used for the image formation, with the detection being in the visible range.

In addition to thermal heads, laser light, infrared flash or heated pens can be used as the heat source for supplying heat energy. Thermal printing heads that can be used to transfer dye from the dye-donor elements of the present invention to a receiver sheet are commercially available. In case laser light is used, the dye layer or another layer of the dye element has to contain a compound that absorbs the light emitted by the laser and converts it into heat, e.g. carbon black.

Alternatively, the support of the dye-donor element may be an electrically resistive ribbon consisting of, for example, a multi-layer structure of a carbon loaded polycarbonate coated with a thin aluminum film. Current is injected into the resistive ribbon by electrically adressing a print head electrode resulting in highly localized heating of the ribbon beneath the relevant electrode. The fact that in this case the heat is generated directly in the resistive ribbon and that it is thus the ribbon that gets hot leads to an inherent advantage in printing speed using the resistive ribbon/electrode head technology compared to the thermal head technology where the various elements of the thermal head get hot and must cool down before the head can move to the next printing position.

The following examples are provided to illustrate the invention in more detail without limiting, however, the scope thereof.

EXAMPLE 1

A polyethylene terephthalate film of 175 um provided with a conventional subbing layer was coated with a composition for forming the receiving layer comprising binder and non-polymeric compound containing active hydrogen-containing radicals and dried at 100° C. for 1 minute.

Subsequently a composition for forming the toplayer comprising the polyisocyanate compound and optionally other additives in methyl ethyl ketone solvent was applied to this receiving layer and dried at 120° C. for 5 minutes.

Image receiving elements comprising the compounds identified in table 1 below were prepared in this manner.

A commercially available Mitsubishi material type CK 100S was used as dye donor element.

The obtained dye receiving element was printed in combination with the dye-donor element in a Mitsubishi video printer type CP 100E.

The receiver sheet was separated from the dye-donor element and a qualitative assessment of the releasability of the receiving sheet from the donor element is made.

The results are shown in table 1 below. Rating 0 indicates no sticking, rating 1 indicates very little sticking, rating 2 indicates little sticking and rating 3 indicates considerable sticking of receiver element and donor element after heat transfer. In case of ratings 0,1 or 2 there is smooth transport during printing; in case of rating 3 the transport is more difficult due to the sticking tendency of receiver element to donor element.

In the following tables the following abbreviations are used:

PET1 polyester comprising terephthalic acid (20 mole %), isophthalic acid (19.5 mole %), sulfoisophthalic acid sodium salt (7.5 mole %), 12-hydroxystearic acid (6 mole %), ethylene glycol (23.5 mole %). neopentylglycol (23.5 mole %)

PET2 polyester comprising terephthalic acid (20 mole %). isophthalic acid (19.5 mole %), sulfoisophthalic acid sodium salt (7.5 mole %), 12-hydroxystearic acid (6 mole %). neopentylglycol (47 mole %)

PET3 polyester comprising terephthalic acid (22.5 mole %). isophthalic acid (15 mole %), sulfoisophthalic acid sodium salt (7.5 mole %), docosenylsuccinic acid (5 mole %), ethylene glycol (40 mole %), ethoxylated bisphenol A (10 mole %)

PET4 polyester comprising terephthalic acid (21 mole %), isophthalic acid (17.5 mole %), sulfoisophthalic acid sodium salt (7.5 mole %), 12-hydroxystearic acid (8 mole %), neopentylglycol (36 mole %). ethoxylated bisphenol A (10 mole % )

PET5 polyester comprising terephthalic acid (20 mole %), isophthalic acid (17.5 mole %). sulfoisophthalic acid sodium salt (7.5 mole %), 12-hydroxystearic acid (10 mole %), neopentylglycol (45 mole %)

| | |
|---|---|
| SOLVIC | SOLVIC 560RA supplied by Solvay co-vinylchloride/vinylacetate 88/12 wt % |
| DDTA | dodecyldiethylene triamine |
| DETA | diethylene triamine |
| HMDA | hexamethylene diamine |
| EDA | ethylene diamine |
| TCDD | tricyclodecyl diamine |
| JAT | Jeffamine T-403 supplied by Texaco |

-continued

| | |
|---|---|
| DAA | diamino anisole |
| PPD | paraphenylene diamine |
| DADFM | p,p-diaminodiphenylmethane |
| DADFS | 4,4-diaminodiphenylsulfone |
| HT | 1,2,6-hexane triol |
| DDD | 1,2-dodecane diol |
| GLY | glycerine |
| GMC | glycerine monocaprylate |
| GMS | glycerine monostearate |
| UNI14 | UNIDYME 14 supplied by Union Camp |
| UNI60 | UNIDYME 60 supplied by Union Camp |
| PHP | 1,2,3,4,5-pentahydroxy-pentane |
| PTC | 1,2,3-propane-tricarboxylic acid |
| PMA | pyromellitic acid |
| DHB | 2,4-dihydroxy benzoic acid |
| THB | 1,3,5-trihydroxy benzene |
| GLU | glucose |
| MIT | mannite |
| MTO | maltose |
| NMG | N-methyl-D-glucamine |
| LYS | lysine |
| GCI | glycine |
| ABA | amino succinic acid |

-continued

| | |
|---|---|
| HEEDA | N-hydroxyethylethylene diamine |
| ASA | acetylsalicylic acid |
| OQ | oxygen quencher (OQ1) listed above |
| ARB1 | arborole compound listed above |
| ARB2 | arborole compound listed above |
| MEK | methyl ethyl ketone |
| H2O | water |
| DDVL | DESMODUR VL supplied by Bayer |
| DBTDL | dibutyltin dilaurate |
| TEA | triethylamine |
| TEGO | TEGOGLDE 410 supplied by Goldschmidt |

The amounts are indicated in g/m$^2$.

TABLE 1

| | receiving layer | | | | toplayer | | | |
|---|---|---|---|---|---|---|---|---|
| binder | g/m2 | additive | g/m2 | solvent | DDVL | DBTDL | TEGO | rating |
| PET1 | 2 | / | / | MEK | 0.5 | / | / | 3 |
| PET1 | 2 | DDTA | 0.5 | MEK | 0.25 | / | / | 1 |
| PET1 | 2 | DDTA | 0.5 | MEK | 0.5 | / | / | 1 |
| PET1 | 2 | DDTA | 0.5 | MEK | 1.0 | / | / | 1 |
| PET2 | 2 | DDTA | 0.5 | MEK | 0.5 | / | / | 1 |
| PET2 | 2 | DDTA | 0.5 | MEK | 0.5 | / | 0.05 | 0 |
| PET1 | 4 | DDTA | 1.0 | MEK | 0.5 | / | 0.05 | 0 |
| PET1 | 5 | DDTA | 0.5 | MEK | 0.5 | / | 0.05 | 0 |
| PET1 | 2 | DETA | 0.5 | MEK | 1.0 | / | / | 2 |
| PET3 | 2 | HMDA | 0.25 | H2O | 0.25 | / | / | 1 |
| PET3 | 2 | HMDA | 0.25 | H2O | 0.5 | / | / | 2 |
| PET3 | 2 | HMDA | 0.5 | H2O | 0.5 | / | / | 2 |
| PET3 | 2 | HMDA | 0.5 | H2O | 0.5 | / | 0.05 | 0 |
| PET4 | 4 | HMDA | 0.5 | H2O | 0.5 | / | 0.05 | 0 |
| PET3 | 2 | EDA | 0.5 | H2O | 0.5 | / | 0.05 | 0 |
| PET4 | 4 | EDA | 0.5 | H2O | 0.5 | / | 0.05 | 0 |
| PET4 | 2 | TCDD | 0.5 | MEK | 0.5 | / | 0.05 | 1 |
| PET4 | 4 | TCDD | 0.5 | MEK | 0.5 | / | 0.05 | 2 |
| PET3 | 2 | JAT | 0.5 | H2O | 0.5 | / | / | 1 |
| PET3 | 2 | JAT | 0.25 | H2O | 0.25 | / | 0.025 | 2 |
| PET3 | 2 | JAT | 0.5 | H2O | 0.5 | / | 0.025 | 1 |
| PET3 | 2 | JAT | 0.5 | H2O | 0.5 | / | 0.05 | 0 |
| PET4 | 2 | JAT | 0.5 | MEK | 0.5 | / | 0.05 | 1 |
| PET4 | 4 | JAT | 0.5 | MEK | 0.5 | / | 0.05 | 1 |
| PET4 | 4 | JAT | 0.5 | H2O | 0.5 | / | 0.05 | 1 |
| PET4 | 2 | JAT | 1.0 | MEK | 0.5 | / | 0.05 | 1 |
| PET4 | 4 | DAA | 0.5 | MEK | 0.5 | / | 0.05 | 1 |
| PET4 | 4 | PPD | 0.5 | MEK | 0.5 | / | 0.05 | 1 |
| PET4 | 4 | DADFM | 0.5 | MEK | 0.5 | / | 0.05 | 2 |
| PET4 | 4 | DADFS | 0.5 | MEK | 0.5 | / | 0.05 | 0 |
| PET4 | 4 | HEEDA | 0.5 | MEK | 0.5 | / | 0.05 | 1 |
| PET4 | 5 | HT | 0.5 | MEK | 0.5 | 0.005 | 0.05 | 1 |
| PET4 | 5 | DDD | 0.5 | MEK | 0.5 | 0.005 | 0.05 | 1 |
| PET4 | 4 | GLY | 0.5 | H2O | 0.5 | / | 0.05 | 0 |
| PET4 | 4 | GMC | 0.5 | MEK | 0.5 | / | / | 2 |
| PET4 | 4 | GMS | 0.5 | MEK | 0.5 | / | 0.05 | 1 |
| PET4 | 2 | UNI14 | 0.5 | MEK | 0.5 | / | / | 1 |
| PET4 | 4 | UN160 | 0.5 | MEK | 0.5 | / | / | 2 |
| PET5 | 4 | PHP | 0.5 | H2O | 0.5 | / | 0.05 | 2 |
| PET5 | 4 | PTC | 0.5 | H2O | 0.5 | / | 0.05 | 1 |
| PET5 | 4 | PMA | 0.5 | H2O | 0.5 | / | 0.05 | 1 |
| PET5 | 4 | DHB | 0.5 | H2O | 0.5 | / | 0.05 | 1 |
| PET5 | 4 | THB | 0.5 | H2O | 0.5 | / | 0.05 | 1 |
| PET5 | 4 | GLU | 0.5 | H2O | 0.5 | / | 0.05 | 1 |
| PET5 | 4 | MIT | 0.5 | H2O | 0.5 | / | 0.05 | 2 |
| PET5 | 4 | MT0 | 0.5 | H2O | 0.5 | / | 0.05 | 1 |
| PET5 | 4 | NMG | 0.5 | H2O | 0.5 | / | 0.05 | 2 |
| PET5 | 4 | LYS | 0.5 | H2O | 0.5 | / | 0.05 | 0 |
| PET5 | 4 | GCI | 0.5 | H2O | 0.5 | / | 0.05 | 2 |
| PET5 | 4 | ABA | 0.5 | H2O | 0.5 | / | 0.05 | 1 |
| PET3 | 4 | ARB1 | 0.5 | H2O | 0.5 | / | 0.05 | 0 |
| PET3 | 4 | ARB2 | 0.5 | H2O | 0.5 | / | 0.05 | 0 |

The above results show that the releasability of the receiving element is improved by using a composition according to the present invention.

EXAMPLE 2

A dye receiving element is prepared in an analoguous manner as indicated in example 1 except for the fact that the isocyanate compound is initially present in the receiving layer and the non-polymeric compound is initially present in the toplayer.

The obtained dye-receiving elements are evaluated as indicated in example 1. The results are listed in Table 2.

TABLE 2

| | receiving layer | | | toplayer | | | |
|---|---|---|---|---|---|---|---|
| binder | g/m2 | DDVL | solvent | additive | g/m2 | TEGO | rating |
| PET5 | 2 | 0.5 | MEK | DDTA | 0.15 | 0.05 | 0 |
| PET5 | 2 | 0.5 | MEK | PMA | 0.15 | 0.05 | 1 |

EXAMPLE 3

A dye receiving element is prepared in an analoguous manner as indicated in example 1 except for the fact that the non-polymeric compound together with the polyisocyanate compound and the polymeric binder are applied in one layer in a composition as indicated in Table 3 below. After drying of this layer (at 100° C. for 1 minute) a post heating at 120° C. for 5 minutes is carried out.

The obtained receiving layers are evaluated as indicated in example 1. The results are listed in Table 3.

TABLE 3

| | receiving layer | | | | | | |
|---|---|---|---|---|---|---|---|
| binder | g/m2 | additive | g/m2 | solvent | DDVL | TEGO | rating |
| PET4 | 4 | DDTA | 0.25 | MEK | 0.5 | 0.1 | 0 |
| PET4 | 4 | HMDA | 0.25 | MEK | 0.5 | 0.1 | 1 |
| PET4 | 4 | HT | 0.25 | MEK | 0.5 | 0.1 | 1 |
| PET4 | 4 | HT | 0.5 | MEK | 0.5 | 0.1 | 1 |

The above results show that a satisfying releasability is also obtained if the composition according to the present invention is applied initially in one layer.

EXAMPLE 4

A dye receiving element is prepared in an analoguous manner as indicated in example 1 but with SOLVIC, a copolymer of vinylchloride and vinylacetate as binder instead of polyester. The layers of which the composition is indicated in Table 4 are coated from MEK and are dried at 1200° C. for 1 minute without a subsequent post heating.

Printing is carried out in an analoguous manner as indicated in example 1.

The release property of the receiving layer is evaluated qualitatively by the ripping out of parts of the dye layer from the donor element by the receiving element after transfer is effected. Rating 0 indicates no delamination; rating 1 indicates very little delamination; rating 2 indicates little delamination; rating 3 indicates strong delamination. In the case of rating 3 large portions of the dye layer are ripped out from the donor element and stick to the printed receiver element.

The results are listed in Table 4 below.

TABLE 4

| | receiving layer | | | | toplayer | | | |
|---|---|---|---|---|---|---|---|---|
| binder | g/m2 | additive | g/m2 | solvent | DDVL | TEA | TEGO | rating |
| SOLVIC | 3.6 | / | / | MEK | / | / | 0.1 | 3 |
| SOLVIC | 3.6 | DDTA | 0.9 | MEK | 1.39 | 0.139 | 0.1 | 0 |
| SOLVIC | 3.6 | DDTA | 0.72 | MEK | 1.11 | 0.111 | 0.1 | 1 |
| SOLVIC | 3.6 | DDTA | 0.36 | MEK | 0.55 | 0.055 | 0.1 | 0 |
| SOLVIC | 3.6 | DDTA | 0.36 | MEK | 0.55 | / | 0.1 | 0 |
| SOLVIC | 3.6 | DDTA | 0.36 | MEK | 1.1 | 0.11 | 0.1 | 0 |
| | | ASA | 0.72 | | | | | |
| SOLVIC | 3.6 | HMDA | 0.9 | MEK | 2.11 | 0.211 | 0.1 | 2 |
| SOLVIC | 7.2 | JAT | 0.72 | MEK | 0.96 | 0.096 | 0.1 | 0 |
| SOLVIC | 7.2 | JAT | 0.72 | MEK | 0.96 | / | 0.1 | 0 |
| SOLVIC | 7.2 | DETA | 0.72 | MEK | 2.86 | 0.286 | 0.1 | 0 |
| SOLVIC | 7.2 | DETA | 0.72 | MEK | 2.86 | / | 0.1 | 0 |
| SOLVIC | 3.6 | HT | 0.36 | MEK | 1.09 | 0.109 | 0.1 | 1 |
| SOLVIC | 3.6 | HT | 0.9 | MEK | 2.7 | 0.27 | 0.1 | 1 |
| SOLVIC | 7.2 | HT | 0.72 | MEK | 2.2 | 0.22 | 0.1 | 0 |
| SOLVIC | 7.2 | GLY | 0.72 | MEK | 3.19 | 0.319 | 0.1 | 0 |
| SOLVIC | 7.2 | GLY | 0.72 | MEK | 3.19 | / | 0.1 | 0 |
| SOLVIC | 3.6 | DDD | 0.36 | MEK | 0.49 | 0.049 | 0.1 | 0 |
| SOLVIC | 3.6 | OQ | 0.9 | MEK | 1.44 | 0.144 | 0.1 | 0 |

EXAMPLE 5

A polyethylene terephthalate film of 175 um that may be provided with a conventional subbing layer is coated with a composition for forming the receiving layer comprising a conventional polyester dye-receiving resin.

Subsequently a composition for forming the toplayer comprising a polyisocyanate compound and a non-polymeric compound containing active hydrogen-containing radicals and a silicone type release agent was applied to this receiving layer and dried at 120° C. for 5 minutes.

Image receiving elements comprising the compounds identified in table 5 below were prepared in this manner.

A commerically available Mitsubishi material type CK 100S was used as dye donor element.

The obtained dye receiving element was printed in combination with the dye-donor element in a Mitsubishi video printer type CP 100E.

The receiver sheet was separated from the dye-donor element and a qualitative assessment of the releasability of the receiving sheet from the donor element was made as described in example 1 above.

The results are listed in table 5 below.

TABLE 5

| | receiving layer | | toplayer | | | | |
|---|---|---|---|---|---|---|---|
| binder | g/m2 | solvent | additive | g/m2 | DDVL | TEGO | rating |
| PET5 | 4 | H2O | / | / | / | 0.05 | 3 |
| PET5 | 4 | H2O | PMA | 0.25 | 0.5 | 0.05 | 1 |
| PET5 | 4 | H2O | HT | 0.25 | 0.5 | 0.05 | 2 |
| PET3 | 4 | H2O | / | / | / | 0.05 | 3 |
| PET3 | 4 | H2O | PMA | 0.125 | 0.25 | 0.025 | 0 |
| PET3 | 4 | H2O | PMA | 0.25 | 0.5 | 0.05 | 0 |
| PET3 | 4 | H2O | GLY | 0.125 | 0.25 | 0.025 | 1 |
| PET3 | 4 | H2O | GLY | 0.25 | 0.5 | 0.05 | 0 |
| PET3 | 4 | H2O | PTC | 0.125 | 0.25 | 0.025 | 1 |

TABLE 5-continued

| | receiving layer | | toplayer | | | | |
|---|---|---|---|---|---|---|---|
| binder | g/m2 | solvent | additive | g/m2 | DDVL | TEGO | rating |
| PET3 | 4 | H2O | PTC | 0.25 | 0.5 | 0.05 | 1 |

These results show that the releasability is also improved by using a toplayer according to the present invention.

We claim:

1. A package containing a dye donor element containing on a support a dye layer and a dye-image receiving element comprising a dye-image receiving layer, said dye-image receiving layer being in communication with a reaction product obtained by crosslinking and curing a non-polymeric compound containing two or more active hydrogen-containing radicals and a compound containing two or more isocyanate groups.

2. The package according to claim 1 wherein said dye-image receiving layer has a layer on top thereof and said reaction product is in said top layer and communicates with said dye-image receiving layer through said top layer.

3. The package according to claim 1 wherein the compound containing two or more isocyanate groups is an aromatic or aliphatic polyisocyanate.

4. The package according to claim 3 wherein said polyisocyanate is a diisocyanate.

5. The package according to claim 4 wherein the diisocyanate is 4,4'-diphenylmethane diisocyanate.

6. The package according to claim 3 wherein said polyisocyanate is a triisocyanate.

7. The package according to claim 1 wherein the non-polymeric compound is a compound containing two or more of the following functional radicals: $—NH_2$, —NH—, —COOH, —OH.

8. The package according to claim 7 wherein said non-polymeric compound contains two, three, four, five or six of said radicals.

9. The package according to claim 7 wherein said non-polymeric compound is selected from the group consisting of amines, alcohols and phenols, carboxylic acids, and hydroxy-amino compounds.

10. The package according to claim 9 wherein said carboxylic acid is a hydroxy-carboxylic acid.

11. The package according to claim 9 wherein said carboxylic acid is an amino-carboxylic acid.

12. The package according to claim 7 wherein said non-polymeric compound is selected from the group consisting of dodecyl diethylene triamine, diethylene triamine, glycerine, hexanetriol, lysine, arboroles, pyromelitic acid and amino succinic acid.

13. The package according to claim 1 wherein the mole ratio of NCO/active hydrogen-containing radical is between 2/1 and 1/10.

14. The package according to claim 1 wherein the mole ratio of NCO/active hydrogen-containing radical is between 1/1 and 1/5.

15. The package according to claim 1 wherein said receiving layer or said top layer further contains a catalyst.

16. The package according to claim 1 wherein the receiving layer contains the cured reaction product and further contains a binder.

17. The package according to claim 16 wherein the binder is selected from the group consisting of polyester, co-vinylchloride-vinylacetate, co-styrene-acrylonitrile, polycarbonate, polyurethane, polyamide and a cellulose.

18. The package according to claim 1 wherein the compound containing two or more isocyanate groups and the non-polymeric compound are initially present in two different layers.

19. The package according to claim 1 wherein said receiving layer or said top layer also contains a silicone release agent.

20. The package according to claim 1 wherein the support is a transparent polyethylene terephthalate film or a blue-colored polyethylene terephthalate film.

21. A process for making a dye transfer image comprising the steps of placing a dye layer of a dye donor element in face-to-face relationship with a dye-image receiving layer of a dye-image receiving element, said dye image-receiving layer being in communication with a reaction product obtained by crosslinking and curing a non-polymeric compound containing two or more active hydrogen-containing radicals and a compound containing two or more isocyanate groups, and image-wise heating said dye donor element from the back.

22. The process according to claim 21 wherein said dye-image receiving layer has a layer on top thereof and said reaction product is in said top layer and communicates with said dye-image receiving layer through said top layer.

23. The process according to claim 21 wherein said dye-image receiving layer has a layer on top thereof and said reaction product is in said top layer and communicates with said dye-image receiving layer through said top layer.

24. The process according to claim 21 wherein the compound containing two or more isocyanate groups is an aromatic or aliphatic polyisocyanate.

25. The process according to claim 24 wherein said polyisocyanate is a diisocyanate.

26. The process according to claim 25 wherein the diisocyanate is 4,4'-diphenylmethane diisocyanate.

27. The process according to claim 24 wherein said polyisocyanate is a triisocyanate.

28. The process according to claim 21 wherein the non-polymeric compound is a compound containing two or more of the following functional radicals: $—NH_2$, —NH—, —COOH, —OH.

29. The process according to claim 28 wherein said non-polymeric compound contains two, three, four, five or six of said radicals.

30. The process according to claim 28 wherein said non-polymeric compound is selected from the group consisting of amines, alcohols and phenols, carboxylic acids, and hydroxy-amino compounds.

31. The process according to claim 30 wherein said carboxylic acid is a hydroxy-carboxylic acid.

32. The process according to claim 30 wherein said carboxylic acid is an amino-carboxylic acid.

33. The process according to claim 28 wherein said non-polymeric compound is selected from the group consisting of dodecyl diethylene triamine, diethylene triamine, glycerine, hexanetriol, lysine, arboroles, pyromelitic acid and amino succinic acid.

34. The process according to claim 21 wherein the mole ratio of NCO/active hydrogen-containing radical is between 2/1 and 1/10.

35. The process according to claim 21 wherein the mole ratio of NCO/active hydrogen-containing radical is between 1/1 an 1/5.

36. The process according to claim 21 wherein said receiving layer or said top layer further contains a catalyst.

37. The process according to claim 21 wherein the receiving layer contains the cured reaction product and further contains a binder.

38. The process according to claim 37 wherein the binder is selected from the group consisting of polyester, co-vinylchloride-vinylacetate, co-styrene-acrylonitrile, polycarbonate, polyurethane, polyamide and a cellulose.

39. The process according to claim 21 wherein the compound containing two or more isocyanate groups and the non-polymeric compound are initially present in two different layers.

40. The process according to claim 21 wherein said receiving layer or said top layer also contains a silicone release agent.

41. The process according to claim 21 wherein the support is a transparent polyethylene terephthalate film or a blue-colored polyethylene terephthalate film.

* * * * *